United States Patent [19]

Decker

[11] 4,387,416

[45] Jun. 7, 1983

[54] WARNING LIGHT HOUSING

[76] Inventor: Wilton K. Decker, 249 Antoine Dr., Port Washington, Wis. 53074

[21] Appl. No.: 298,009

[22] Filed: Aug. 31, 1981

[51] Int. Cl.[3] ..... F21L 7/00

[52] U.S. Cl. ..... 362/190; 362/191; 362/200; 362/367

[58] Field of Search ..... 362/190, 191, 200, 367

[56] References Cited

U.S. PATENT DOCUMENTS

| | | | |
|---|---|---|---|
| 2,931,026 | 3/1960 | Nelson . | |
| 3,015,804 | 1/1962 | Nunn . | |
| 3,135,468 | 6/1964 | Osburn . | |
| 3,221,300 | 11/1965 | Elledge, Jr. . | |
| 3,264,461 | 8/1966 | Osburn | 362/190 X |
| 3,266,015 | 8/1966 | Pickering et al. . | |
| 3,500,378 | 3/1970 | Pickering et al. . | |
| 3,506,959 | 4/1970 | Nunn . | |
| 3,523,290 | 8/1970 | Elledge, Jr. . | |
| 3,604,914 | 9/1971 | Gibson | 362/191 |
| 3,697,738 | 10/1972 | Decker et al. . | |
| 3,818,439 | 6/1974 | Maine . | |
| 4,006,614 | 2/1977 | Decker . | |
| 4,069,404 | 1/1978 | Minoprio et al. . | |

*Primary Examiner*—Stephen J. Lechert, Jr.
*Attorney, Agent, or Firm*—Quarles & Brady

[57] ABSTRACT

A light assembly as used with street construction barricades is disclosed. In one embodiment, there is a base having a supporting platform with recesses in its upper surface, the recesses having a bottom, side walls and an open top. The recesses also have access holes in the bottom leading into the recesses from the exterior. A removable casing fits over the base to form a housing therewith. The casing has an interior cavity with side walls and a top extending above the recesses. A coupling connects the base to the casing upon substantially lateral movement of the base under the cavity. This restricts the vertical movement of the base relative to the casing. Batteries are insertable in the casing cavity so as to recede into the recesses upon assembly of the casing and base. The batteries will then block disassembly by limiting lateral movement of the casing relative to the base. A special tool is insertable in the access holes to push the batteries out of the recesses so as to allow disassembly.

6 Claims, 11 Drawing Figures

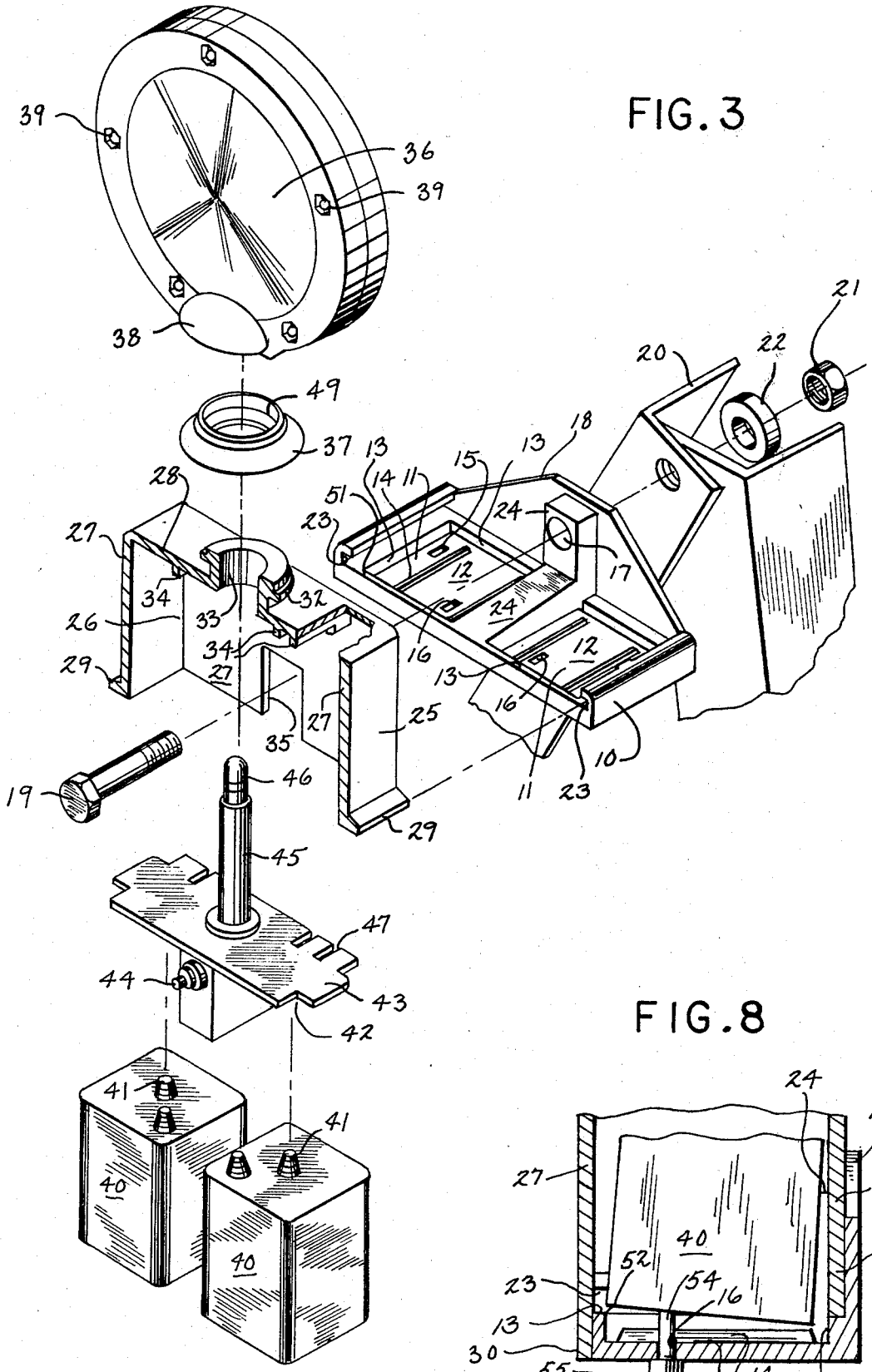
FIG. 3
FIG. 8
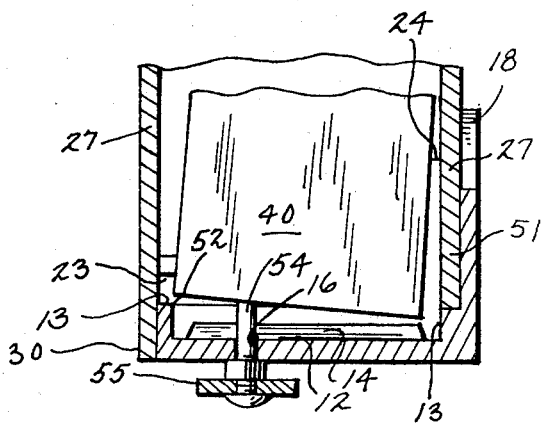

FIG. 4
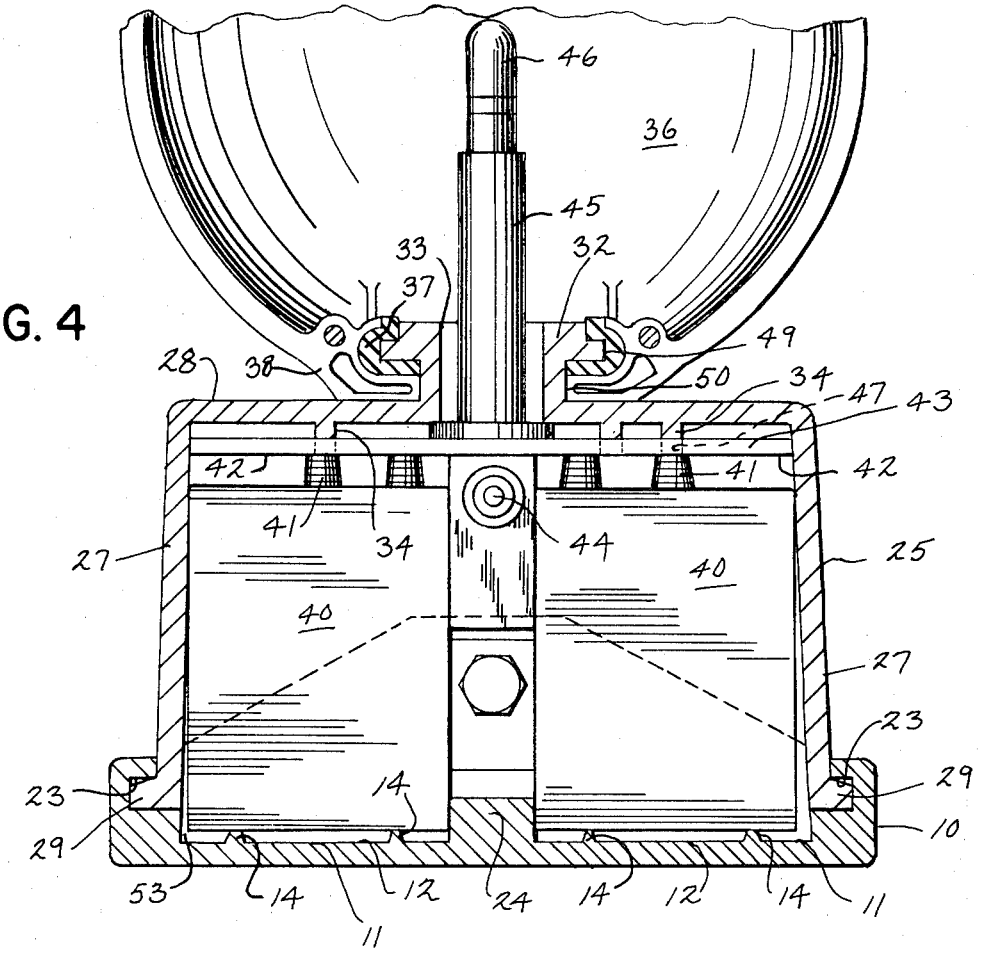
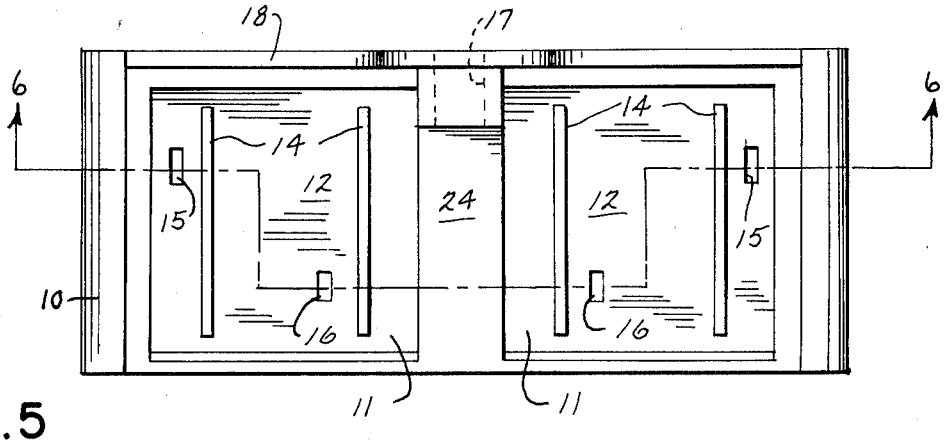
FIG. 5
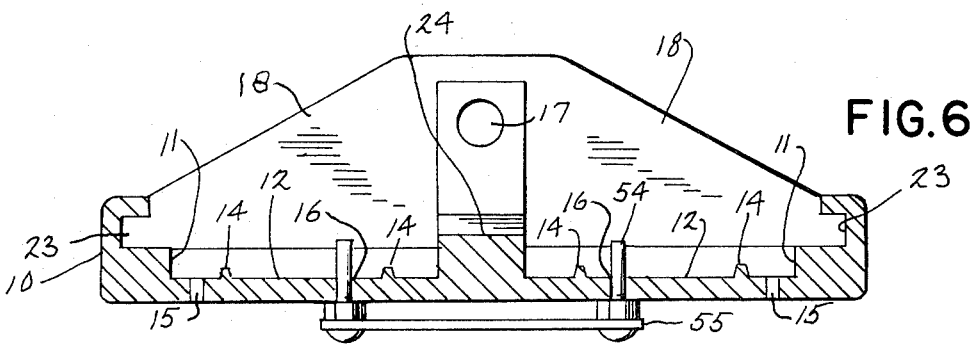
FIG. 6

WARNING LIGHT HOUSING

BACKGROUND OF THE INVENTION

A. Field of the Invention

The present invention relates to electric warning lights as used with street construction barricades to enhance vehicular safety. More particularly, it relates to an improved warning light housing.

B. Description of the Art

Electric warning lights as attached to street construction barricades have proved extremely valuable in improving the safety of travel at night and they are widely used for advising motorists of unsafe or unusual road conditions. However, such lights are a target for vandalism and theft, and if numbers of such lights are rendered inoperative by reason of vandalism, then false indications to motorists might result. It is desirable to thwart vandals and thieves, and to this end the housing for a warning light should be durable, and should be attachable to a barricade in such a manner that it is not easily removed by unauthorized persons.

Another factor which must be taken into account in designing a warning light housing is that regular maintenance is required for the electrical components to change batteries, replace bulbs and repair faulty parts. As it is dangerous to perform extended repair at many barricade sites because of the potential hazards from the flow of nearby traffic, the best practice is to remove the electrical components from the barricade, and then perform maintenance on the components at a central shop. This requires that authorized personnel be able to quickly disassemble the housing and remove the light from the barricade. As such, an optimal housing will allow easy removal by authorized persons, while at the same time inhibiting removal by others.

Various attempts have been made to meet these needs. For example, in U.S. Pat. No. 3,697,738, a housing was disclosed which included a base secured to a barricade and a casing affixed to the base. A special tool was required to remove a bolt connecting the casing and base. This construction was generally satisfactory, but occasionally thieves were able to jimmy the connection between the base and casing.

Another attempt to meet these needs was U.S. Pat. No. 4,006,614 which disclosed the use of a plug-type lock and key securing the base to the casing. However, because some warning lights are exposed to road salts, water, and ice, such locks would occasionally jam.

Thus, it can be seen that the need has existed for a warning light housing which improved upon the performance of prior art housings in dealing with the problems discussed above.

SUMMARY OF THE INVENTION

The present invention relates to an improved warning light housing having a base portion that provides a supporting platform for internal components of the light, a recess formed in the upper side of the platform into which a component of the light, usually a rectangular battery having contact springs, may be resiliently biased, an access hole in the base platform entering upon the recess, and a removable casing fitting over the base that has an internal cavity for receiving components of the light. The insertion of a tool through the access hole can raise the light component to permit disassembly of the casing from the base. Such disassembly is normally blocked by interposition of the light component between the base and casing.

In a preferable form of the housing, the base and casing are coupled together by a tongue and groove that permit a lateral sliding motion between the casing and the base. Once coupled together, vertical movement of the casing relative to the base is restricted. In assembly of the warning light, batteries are placed inside the casing, and when the casing is slid onto the base, the batteries drop into the recess formed in the upper side of the base. The batteries then block lateral movement of the casing away from the base, so as to positively restrain separation of the casing and base.

Because the batteries are resiliently biased downwardly into the recess, a special tool can be used to raise the batteries upwardly out of the recess, in order to allow disassembly of the housing and base. The tool is inserted through the access hole in the base and pressed upwardly against the bottom of the batteries to push the batteries upwardly out of the recess. Once the batteries clear the recess, the casing and the base are free to slide laterally away from each other.

The housing protects the electrical components of the warning light against vandalism by making unauthorized access to the internal components difficult, while at the same time it allows authorized access by those who have the special tool. Preferably, the housing is also formed to protect the internal components of the light from exposure to water and road salts, and to allow any water which does enter to seep out. To this end, the preferred embodiment includes support ledges and bleed holes in the recess, and a protective shroud covering the interior of the assembled base and casing. Also, the connection of the base to a barricade or other structure is inside the assembled base and casing, so that it is only accessible by removing the casing through use of the special tool. This inhibits theft of the warning lights as well as vandalism.

The objects of the invention therefore include:

(a) providing a warning light housing of the above kind which is durable and resistant to vandalism, which also allows authorized personnel to have easy access to the internal components of the light;

(b) providing a warning light housing of the above kind which is comprised of few parts, and is easily and inexpensively produced;

(c) providing a warning light housing of the above kind which protects the internal components of the light from the elements; and (d) providing a warning light assembly having a warning light housing of the above kind.

These and still other objects and advantages of the invention will be apparent from the description which follows. In the detailed description below, preferred embodiments of the invention will be described in reference to the accompanying drawings. These embodiments do not represent the full scope of the invention, but rather the invention may be employed in other embodiments. Reference therefore should be made to the claims herein for interpreting the breadth of the invention.

BRIEF DESCRIPTION OF THE DRAWINGS

FIG. 3 is an exploded perspective view, partially in section, of the housing of FIG. 1, together with interior components of the light assembly;

FIG. 4 is a sectional view taken on line 4—4 in FIG. 2, showing batteries and a light unit mounted in the housing;

FIG. 5 is a plan view of the base portion of the housing shown in FIG. 3;

FIG. 6 is a sectional view taken on line 6—6 in FIG. 5, with the special tool of FIG. 7 shown projecting into the base;

FIG. 8 is a partial sectional view taken on line 8—8 in FIG. 1 showing how the special tool can raise a battery for disassembly of the warning light;

DESCRIPTION OF THE PREFERRED EMBODIMENT

Figure 1:
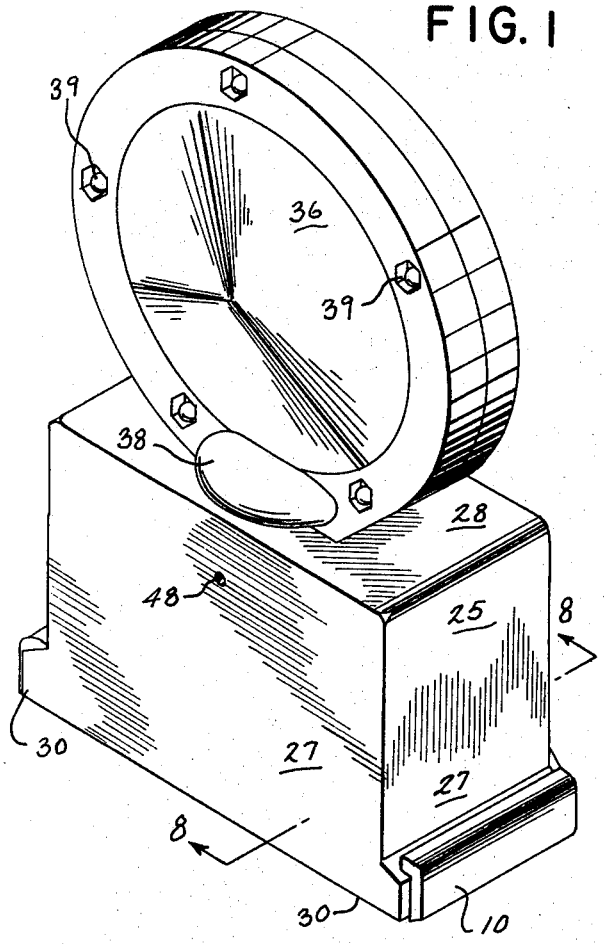
FIG. 1 is a front perspective view of the warning light housing of the present invention with a light lens attached thereto.

Referring now to the drawings, there is shown a housing base 10 which has two rectangular recesses 11 formed in its upper face. The recesses 11 have a bottom 12, side walls 13 and an open top. There are four elongated platforms or ribs 14 along the bottom 12 of these recesses and bleed holes 15 and access holes 16 are formed through the bottom of the recesses.

Bolt hole 17 projects through a trapezoidal back plate 18 of the base 10, to the back of the base. A suitable headed bolt 19 is insertable in this hole 17, and the bolt 19 can then be used to connect the base 10 to a construction barricade 20 using a conventional mounting system including mounting nuts 21 and washer 22, such as the one described in detail in U.S. Pat. No. 3,697,738.

With particular reference to FIG. 4, it will be noted that running along the sides of the base 10 are grooves 23. The grooves 23 are formed on opposite interior sidewalls of the base 10, are open at one end, and run substantially laterally along the sides of the base. To separate the recesses 11 a pier 24 is formed which runs between the recesses 11 and up along the back plate 18.

Removable casing 25 is assembled with the base 10 to form a housing therewith. As best seen in FIG. 3, there is an internal cavity 26 in the casing 25 that has side walls 27 and a top 28.

At the bottom of the casing 25 are exterior flanges 29. These flanges extend along opposite sides of the casing, near the lower ends thereof. It will be appreciated that the flanges 29 run substantially normal to the vertical axis of the casing 25, and thus laterally extend across two of the sides of the casing. The flanges 29 are of a size that they may be slid into the grooves 23 of the base 10.

Figure 2:
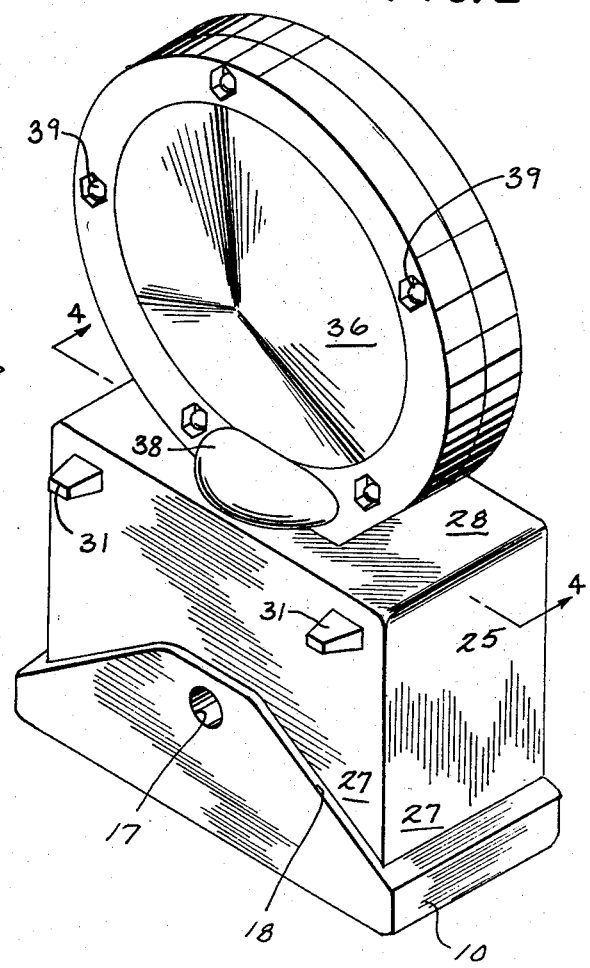
FIG. 2 is a rear perspective view of the housing and lens of FIG. 1.

As seen in FIG. 1, at the right and left lower front corners of the casing 25, flanges 29 mold into a downwardly projecting shield 30. Another feature of the casing 25 is two exterior rear projections 31 (FIG. 2) which are formed so as to contact suitable surfaces of barricade 20 when the casing 25 is mounted on the barricade. The projections 31 act to restrain the casing 25 from rotating too far from the vertical due to wind or other forces.

Casing 25 also has a collar 32 extending upwardly from the cavity top wall 28 around a cylindrical passage 33, through the wall, and alignment projections 34 which extend downwardly from the cavity top wall 28. Rectangular notch 35 is formed in a side wall 27 of the cavity 26 and is of a size slightly larger than the upstanding portion of pier 24.

A transparent lens 36 is formed by two circular hollow, disk-shaped shells. The lens 36 is mounted on the casing 25 via an elastic mounting gasket 37 which is stretched and snapped over collar 32. As shown in FIG. 4, each half of the lens 36 has an enlarged lower platform section 38 which assembles around the gasket 37. Once this is done, side screws 39 (FIG. 1) then secure the lens halves together in assembled position on the collar 32.

In FIGS. 3 and 4, there are shown conventional rectangular batteries 40 having compressible contact springs 41 at their tops. These contact springs are positioned against the bottom 42 of a conventional light unit 43 so as to provide electricity to the unit through metal contacts running along the underside 42 of the light unit 43. Internal wiring in the light unit 43 carries the electricity through a depressable switch 44, and then through a conduit 45 to bulb 46. Light unit 43 also has alignment grooves 47 along one side. Alignment projections 34 in the top of the casing 25 cooperate with the alignment grooves 47 on the light unit 43 to position the light unit along the top of the casing 25 in the internal cavity 26.

As best seen in FIG. 1, there is a small hole 48 in a side wall 27 of the casing 25 which allows one to control the switch 44 from the outside of the casing by inserting a tool through the hole 48 and pressing the aligned switch 44 on and off.

Conduit 45 of light unit 43 is formed so as to be insertable in opening 33 in the top wall 28 of the casing 25. By inserting conduit 45 in this manner, the conduit also passes through opening 49 in gasket 37 and hole 50 in the bottom of the enlarged lower platform section 38 of the lens 36. This places bulb 46 in the middle of lens 36.

The assembly functions as follows. As the casing 25 and the base 10 are slid together to form a housing by substantially lateral movement of the base 10 under the internal cavity 26 of the casing 25, the grooves 23 and flanges 29 mate. Batteries 40 which have been previously placed in the internal cavity 26 of the casing 25 underneath the light unit 43, are then free to drop into the recesses 11 in the base 10, due to the force of battery springs 41 on the underside of the light unit 43 and gravity. The compressing of the springs 41, and the depth of the recesses are such that the light 46 will still work when the batteries 40 have dropped into the recesses 11.

It will be appreciated that once assembled, the base 10 cannot be separated from the casing 25 by simple vertical movement of the casing 25 away from the base 10, as once the casing and base are slid together, the contact between flanges 29 and grooves 23 will prevent this. Further, as the batteries 40 have dropped into the recesses 11, if one tries to slide the casing 25 away from the base 10 by lateral movement, a portion 51 of the casing back wall 27 contacts the sides of the batteries 40, pushing the lower end of the batteries against the interior 52 of recess front wall 13 (FIG. 8). The batteries 40 will then be unable to move further sideways, thereby holding the casing 25 together with the base 10. The compression of the springs 41 insures that the batteries 40 cannot simply be jarred out of the recesses.

Once the housing is assembled, the back plate 18 on the base 10 acts to protect the connection between the base and casing from the elements by covering notch 35 in the casing. The notch 35 is of a size such that it fits snugly around pier 24. Likewise, shield 30 forms a limit of how far the flanges 29 can be slid into the grooves 23, while at the same time acting to cover and protect the front rim of the base 10.

When the light is assembled, the batteries 40 sit on the ribs 14 (FIG. 4). The reason for this construction is that occasionally rain water and road salt may enter the assembly. However, bleed holes 15 will allow most of the water to exit from the base 10. Nevertheless, some water may be retained in the bottom of recesses 11, and if this water were to contact the batteries 40 for an extended period, it might corrode the battery bottoms. To protect the batteries, the ribs 14 hold the batteries up from the recess bottoms 12 somewhat, thereby keeping them drier. Also, the batteries 40 are of a size such that the bottoms of the batteries are free to move axially downward into the recesses as at point 53 in FIG. 4.

Figure 7:
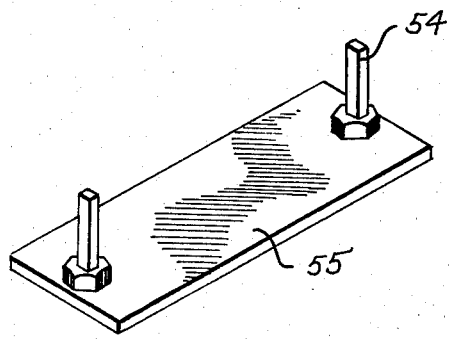
FIG. 7 is a perspective view of a special tool which can be used to disassemble the warning light housing of the present invention.

It will be appreciated that in the event the batteries 40 could be moved up only a slight amount, so as to be raised over front wall 13 of the recesses 11, the batteries could then continue to slide over the wall, and the casing 25 could then push the batteries 40 sideways until the flanges 29 were slid out of the grooves 23. This can be achieved as follows. As seen in FIGS. 6–8, two projections 54 of special tool 55 can be pushed through access holes 16. This will cause the batteries 40 to be pushed up against the compression of the springs 41, and above the front wall 13. The casing 25 can then be slid away from the base 10.

In sum, spring pressure and gravity are used to keep the batteries 40 in the recesses 11. The batteries 40 cannot be removed from the recesses without a special tool, and while the batteries are in the recesses, they prevent the disassembly of the device. Thus, the warning light housing of the present invention provides a housing which is vandal resistant, while allowing for access by authorized persons having the special tool. The warning light may be attached to a construction barricade, and readily removed when repair is required. The internal bolt inhibits unauthorized removal from the barricade. Further, the housing gives the internal components of the warning light protection from the elements.

Figure 9:
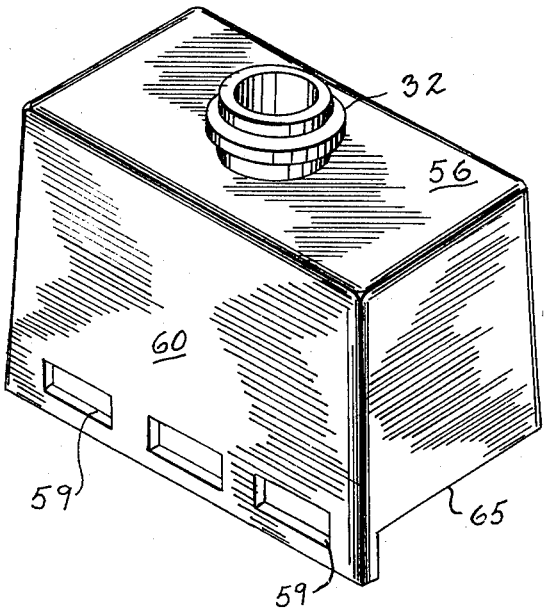
FIG. 9 is a front perspective view of a second embodiment of the casing portion of the invention.
Figure 10:
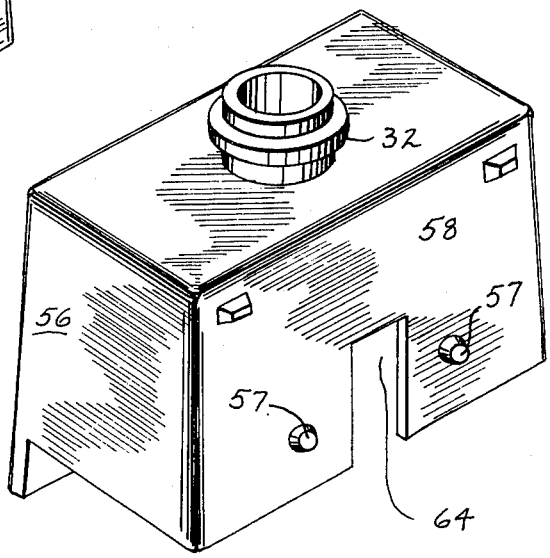
FIG. 10 is a rear perspective view of the casing shown in FIG. 8.
Figure 11:
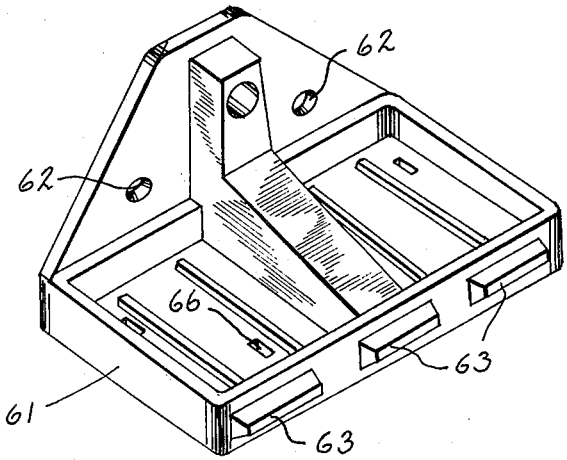
FIG. 11 is a second embodiment of the base portion of the housing of the present invention.

FIGS. 9–11 show a second embodiment of the present invention. In this embodiment, the laterally slidable recess and projection coupling means are not flanges 29 and grooves 23. Rather, the casing 56 has rounded projections 57 extending outwardly of a front wall 58 of the casing, and several elongated slots 59 in the back wall 60. The base 61 has corresponding holes 62 which mate with rounded projections 57, and elongated rims 63 which mate with slots 59. Upon sliding the base 61 underneath the cavity 64 of the casing 56, the casing and base may be coupled together. At point 65, the casing 60 terminates in a wall, not ledge. However, as before there are access holes 66 in the base.

The housing of the present invention is preferably cast from metal, although it may also be made from a wide variety of other substances such as plastic. The batteries, light unit, lens, and gasket can be selected from prior art components including those disclosed in U.S. Pat. Nos. 3,266,015 and 3,500,378.

It will be appreciated that in addition to these embodiments, the basic concept of the invention can appear in other embodiments. For example, rather than using spring contacts on the batteries, resilient members can be inserted at other points in the assembly to cause the batteries or other components of the light to move into the compartments. Thus, there may be various other modifications and changes to the embodiments which have been shown which are within the scope of the invention. Such modifications and changes are meant to be within the scope of the invention and as such the invention is not to be limited by the illustrative description above but only by the claims which follow.

I claim:

1. In a light assembly, the combination comprising:

a base having a supporting platform with a recess in its upper face that has a bottom, side walls and an open top, said base also having an access hole in said bottom leading into said recess from the exterior;

a removable casing fitting over said base to form a housing therewith, said casing having a cavity with side walls and a top extending above said recess;

a coupling between said base and casing for assembly and disassembly of said casing with and from said base in a lateral movement, said coupling restricting vertical removal of said casing from said base;

a light assembly component insertable in said casing cavity which recedes into said recess upon assembly of the component with said base and casing, said component being in interfering position with sidewalls of said cavity and said recess to block lateral disassembly of said casing from said base; and said light assembly component being elevatable out of said recess upon insertion of a tool through said access hole, thereby shifting said component from its interfering position to permit lateral disassembly of said casing and base.

2. A light assembly as in claim 1 having:

a light unit in said housing with a portion thereof located in said cavity; and said light assembly component comprising a battery with spring contacts on the top thereof, said contacts being compressed against said light unit to resiliently bias said battery downwardly into said recess.

3. A light assembly as in claim 1, wherein the coupling comprises:

outwardly extending exterior flanges adjacent the lower end of the casing running substantially laterally along opposite sides thereof; and substantially lateral grooves formed along opposite interior side walls of the base, the grooves being open at at least one end, such that the flanges may be slid into the grooves.

4. A light assembly as in claim 1, wherein the coupling comprises:

a slot in a side wall of the casing;

a projection extending outwardly from the opposite side of the casing;

a hole in a wall of the base for mating with the projection on the casing; and an outwardly extending ledge on an opposite wall of the base for mating with the slot on the casing, whereby the base and casing may be slid together.

5. A light assembly as in claim 1, wherein the recess is divided into two sections by a pier, and each such section has at its bottom an elongated raised support rib and a bleed hole.

6. In a light assembly of the type having a light unit and a plurality of batteries, the batteries having coiled tension contact springs abutting against the light unit, wherein the improvement comprises:

a base forming a supporting platform for the batteries, the base having recesses in its upper face into which the batteries may be resiliently biased by the force of the springs against the light unit, the base also having access holes connecting the bottom of the base with each recess;

a through bolt having a headed end, the bolt being directable through the base to secure the base to an object;

a casing fitting over the base to form a housing therewith, the casing having a downwardly open internal cavity for receiving the light unit and batteries, the top of the cavity limiting the upward vertical movement of the light unit, and the casing also having an opening between the cavity and the exterior of the casing through which the light unit extends; and laterally slideable recess and projection coupling means which connect the casing to the base upon substantially lateral movement of the base under the cavity, the coupling means restricting vertical movement of the casing relative to the base while allowing the resiliently biased batteries to fall into the recessed compartments in the base, the batteries thereby restricting lateral movement of the casing relative to the base until a tool is inserted in the access holes to offset the resilient bias and push the batteries out of the recesses.

* * * * *